US012055001B2

(12) United States Patent
Mammadov et al.

(10) Patent No.: US 12,055,001 B2
(45) Date of Patent: Aug. 6, 2024

(54) MONOBORE DRILLING METHODS WITH MANAGED PRESSURE DRILLING

(71) Applicant: Opla Energy Ltd., Calgary (CA)

(72) Inventors: Elvin Mammadov, Calgary (CA); Shawn Cody, Calgary (CA); Ahmad Alizadeh, Calgary (CA)

(73) Assignee: Opla Energy Ltd., Calgary (CA)

( * ) Notice: Subject to any disclaimer, the term of this patent is extended or adjusted under 35 U.S.C. 154(b) by 462 days.

(21) Appl. No.: 17/226,763

(22) Filed: Apr. 9, 2021

(65) Prior Publication Data

US 2021/0317714 A1 Oct. 14, 2021

Related U.S. Application Data

(60) Provisional application No. 63/007,873, filed on Apr. 9, 2020.

(51) Int. Cl.

| | |
|---|---|
| ***E21B 21/08*** | (2006.01) |
| ***E21B 21/16*** | (2006.01) |
| ***E21B 47/06*** | (2012.01) |
| *E21B 37/00* | (2006.01) |

(52) U.S. Cl.

CPC ..... *E21B 21/082* (2020.05); *E21B 21/16* (2013.01); *E21B 47/06* (2013.01); *E21B 37/00* (2013.01)

(58) Field of Classification Search

CPC ..... E21B 21/085; E21B 21/08; E21B 21/067; E21B 44/00

See application file for complete search history.

(56) References Cited

U.S. PATENT DOCUMENTS 5,612,493 A * 3/1997 Alexander ..... E21B 49/086 73/152.55
6,105,689 A * 8/2000 McGuire ..... E21B 21/08 175/48
6,367,566 B1 * 4/2002 Hill ..... E21B 43/26 175/215

(Continued)

OTHER PUBLICATIONS

Sugden, C. et al.; IADC/SPE 168028: "Real-Time Casing Design Optimization: A Case Study in Using Managed Pressure Drilling to Develop an Adaptive Well Design and Eliminate Casing Strings on a Deep Water Exploration Well"; IADC/SPE Drilling Conference and Exhibition, Forth Worth, Texas, U.S.A; Mar. 4-6, 2014.

*Primary Examiner* — Kipp C Wallace
(74) *Attorney, Agent, or Firm* — Laurie Wright; Christopher Hunter; Blake, Cassels & Graydon LLP

(57) ABSTRACT

A method for drilling a wellbore comprises using drilling mud having a mud weight less than the formation pore pressure while drilling the horizontal section, to release some formation gas to mix with the drilling mud. As the mixture flows up the wellbore annulus, the resulting pressure in the vertical section is within the mud weight window (MWW) of the weak zones, thereby maintaining wellbore stability without the need for intermediate casings. The wellbore is killed by introducing a volume of heavy mud via a circulation sub in the drill string and periodically introducing additional heavy mud to fill the void left behind by the drill string as it is pulled uphole. The ratio of light mud and heavy mud in the killed well is such that the resulting pressure in the vertical section is within the MWW of the weak zones.

9 Claims, 14 Drawing Sheets

(56) References Cited

U.S. PATENT DOCUMENTS

| | | | | |
|---|---|---|---|---|
| 7,044,237 | B2 * | 5/2006 | Leuchtenberg | E21B 44/00 175/48 |
| 2005/0252286 | A1 * | 11/2005 | Ibrahim | G01N 33/2823 73/152.55 |
| 2007/0246263 | A1 * | 10/2007 | Reitsma | E21B 21/06 175/48 |
| 2008/0060846 | A1 * | 3/2008 | Belcher | E21B 47/06 175/25 |
| 2011/0139464 | A1 * | 6/2011 | Henderson | E21B 47/10 166/370 |
| 2015/0083494 | A1 * | 3/2015 | Noske | E21B 21/08 175/48 |

* cited by examiner

MONOBORE DRILLING METHODS WITH MANAGED PRESSURE DRILLING

CROSS-REFERENCE TO RELATED APPLICATIONS

This application claims the benefit of U.S. Provisional Application No. 63/007,873, filed Apr. 9, 2020, the content of which is hereby incorporated by reference in its entirety.

FIELD

The present disclosure relates generally to wellbore drilling operations and, more particularly, to methods of drilling a wellbore and methods of killing a wellbore.

BACKGROUND

For conventional wellbore drilling operations, the mud weight window (MWW) is a range of values for mud density, which helps ensure wellbore and pressure stability during the drilling process at a given depth. A mud weight is chosen within the MWW to prevent plastic deformation on the wellbore surface and mud loss. The MWW is generally dictated by a lower boundary, which is the larger value of the pore pressure gradient (or "pore pressure"), or the shear failure gradient, which is the minimum mud weight required for keeping the wellbore away from plastic failure; and an upper boundary, which is the so-called fracture gradient (or "fracture pressure"), which is the maximum value of mud weight that can be used without inducing any fracture openings in the formation. The pore pressure and fracture pressure of the formation generally increase with depth so as the drilling progresses deeper downhole, the mud weight is increased to be within the MWW.

Typically, to prevent the increase in mud weight from fracturing the strata around previously drilled, shallower portions of the wellbore, one or more intermediate casings are installed to isolate these strata from the drilling mud and higher pressure formations deeper in the well. However, with each casing installation, the drilling is paused and the drill string has to be tripped out completely before a casing can be run and cemented in the wellbore. Therefore, the need to install intermediate casings increases well construction time and the overall cost of wellbore drilling operations.

Therefore, it is desirable to develop an alternative drilling method that can reduce or eliminate the need for intermediate casings, and the flat time associated with running intermediate casings, while maintaining wellbore and pressure stability during drilling operations.

SUMMARY

According to a broad aspect of the present disclosure, there is provided a method for drilling a wellbore, the method comprising: a) drilling a first section of the wellbore, the first section having a first fracture pressure and a first pore pressure; b) applying a backpressure on the wellbore; c) drilling a second section of the wellbore, the second section being downhole from the first section and having a second pore pressure, wherein drilling the second section comprises using drilling mud having a mud weight less than the second pore pressure to draw gas from a formation around the second section into the wellbore; d) monitoring, while drilling the second section, an annulus pressure in the first section; e) comparing the annulus pressure with the first fracture pressure and the first pore pressure; and f) one of:

if the annulus pressure is between the first fracture pressure and the first pore pressure, maintaining the backpressure on the wellbore; if the annulus pressure is at or above the first fracture pressure, decreasing the backpressure on the wellbore; and if the annulus pressure is at or below the first pore pressure, increasing the backpressure on the wellbore.

In some embodiments, the first section is a vertical section of the wellbore and the second section is a horizontal section of the wellbore.

In some embodiments, the method comprises repeating steps d) to f).

In some embodiments, monitoring the annulus pressure comprises: receiving at surface a two-phase drilling mud mixture from the wellbore, the two-phase drilling mud mixture containing the gas and a liquid; separating the gas from the liquid in the two-phase drilling mud mixture to provide a separated gas and a separated liquid; measuring a flow rate of the separated gas; determining the annulus pressure in the first section based, at least in part, on the flow rate of the separated gas.

In some embodiments, determining the annulus pressure in the first section comprises: measuring a flow rate, a density, and a viscosity of the separated liquid; determining a viscosity and a density of the gas; dividing the length of the first section into a plurality of grids, each grid of the plurality of grids having a grid temperature and a grid pressure; and determining the grid pressure of each grid based, at least in part, on the backpressure, the flow rate, the density, and the viscosity of the separated liquid, the flow rate of the separated gas, and the density and the viscosity of the gas.

In some embodiments, the method comprises determining the grid temperature of each grid.

In some embodiments, the grid pressure of a grid of the plurality of grids is determined iteratively by:

$$P_j^i = P_{j-1}^i + P_{H_{j-1\to j}}^{i-1} + P_{F_{j-1\to j}}^{i-1}$$

where $P_j^i$ is the grid pressure of the grid at the ith iteration, $P_{j-1}^i$ is the grid pressure of a previous grid immediately uphole from the grid, $$P_{H_{j-1\to j}}^{i-1}$$

is a hydrostatic pressure taking into account the increase in depth from the previous grid to the grid, and $$P_{F_{j-1\to j}}^{i-1}$$

is an annular pressure loss.

In some embodiments, the plurality of grids has an uppermost grid representing an area of the first section closest to surface and the method comprises iteratively determining the grid pressure for each grid of the plurality of grids, sequentially starting from the uppermost grid, until a maximum difference between two consecutively calculated grid pressures for the same grid is smaller than a predetermined tolerance E:

$$|P_j^{i+1} - P_j^i| \leq \epsilon.$$

In some embodiments, for each grid of the plurality of grids, the density $\rho_g$ of the gas is determined by:

$$\rho_g = \frac{PMW}{ZRT}$$

where P is the grid pressure of each grid, MW is gas molecular weight of the gas, Z is a gas compressibility factor, R is the universal gas constant, and T is the grid temperature of each grid.

In some embodiments, the gas compressibility factor Z is determined by Peng-Robinson equation of state or Soave-Redlick-Kwong equation of state.

According to another broad aspect of the present disclosure, there is provided a method of killing a wellbore, the wellbore having: a weak zone having a weak zone depth; a heel downhole from the weak zone, the heel having a heel depth; a horizontal section downhole from the heel; and a drill string extending therein, the drill string having a proximal end, a distal end, a wall having an inner surface defining an inner bore extending between the proximal and distal ends, and a circulation sub provided between the proximal and distal ends, the drill string and an inner surface of the wellbore defining an annulus therebetween, the method comprising: cleaning the wellbore by circulating a light mud from the proximal end to the distal end via the inner bore, and out of the distal end into the annulus; opening the circulation sub to allow fluid communication between the inner bore and the annulus through the circulation sub; introducing, from the proximal end, an initial volume of heavy mud, via the inner bore to the circulation sub, and out of the circulation sub into the wellbore, the heavy mud having a mud weight greater than that of the light mud; pulling the drill string uphole; periodically introducing additional volumes of heavy mud as the drill string is pulled uphole; upon determining that the circulation sub is at the top of the heavy mud or that the heavy mud is backing up the inner bore, closing the circulation sub to restrict fluid communication between the inner bore and the annulus via the circulation sub; and pulling the drill string out of the wellbore.

In some embodiments, the mud weight of the heavy mud $\rho_k$ is determined by:

$$\rho_k = \frac{P_r - P_w}{g \times \Delta d}$$

where $P_r$ is a reservoir pressure in the horizontal section, $P_w$ is a hydrostatic pressure of the light mud, g is a gravity constant, $\Delta d$ is a true vertical depth difference between the weak zone and the heel.

In some embodiments, the method comprises, after pulling the drill string out of the wellbore, extending a casing into the wellbore such that at least a portion of an outer surface of the casing at the weak zone is surrounded by the heavy mud, and at least a portion of the outer surface of the casing below the heel is surrounded by the light mud.

In some embodiments, the initial volume of heavy mud $V_k$ is determined by:

$$V_k=(d_k-d_w)\times(A_a+A_i+A_m)$$

where $d_k$ is a kill depth, $d_w$ is the weak zone depth, $A_a$ is the cross-sectional area of the annulus, $A_i$ is the cross-sectional area of the inner bore, and $A_m$ is the cross-sectional area of the wall.

In some embodiments, the kill depth $d_k$ is determined by:

$$d_k = d_h + \left(\frac{\left(\left(\frac{\Pi}{4}\left(D_{OH}^2 - D_{PC}^2\right)\right) \times (d_{td} - d_h)\right)}{\frac{\Pi}{4} D_{OH}^2}\right)$$

where $d_h$ is the heel depth, $D_{OH}$ is a diameter of the wellbore, $D_{PC}$ is an outer diameter of the casing, and $d_{td}$ is the measured depth of the wellbore.

In some embodiments, the method comprises, after introducing the initial volume of heavy mud, shutting down surface pumps and performing a flow check on the wellbore.

In some embodiments, the method comprises, as the drill string is pulled uphole: determining a location of the top of the heavy mud based on volumetric calculations; determining a current location of the circulation sub by monitoring the distance the drill string has been pulled uphole; and comparing with the location of the top of the heavy mud with the current location of the circulation sub.

In some embodiments, after pulling the drill string out of the wellbore, the ratio of the light mud and heavy mud in the wellbore results in an annulus pressure in the weak zone that is within the mud weight window of the weak zone The details of one or more embodiments are set forth in the description below. Other features and advantages will be apparent from the specification and the claims.

BRIEF DESCRIPTION OF THE DRAWINGS

Embodiments will now be described by way of example only, with reference to the accompanying simplified, diagrammatic, not-to-scale drawings. Any dimensions provided in the drawings are provided only for illustrative purposes, and do not limit the scope as defined by the claims. In the drawings:

DETAILED DESCRIPTION OF THE EMBODIMENTS

All terms not defined herein will be understood to have their common art-recognized meanings. To the extent that the following description is of a specific embodiment or a particular use, it is intended to be illustrative only, and not limiting. The following description is intended to cover all alternatives, modifications and equivalents that are included in the scope, as defined in the appended claims.

According to embodiments herein, a drilling method allows hydrocarbon gases from a subterranean formation to mix with the drilling mud to control the mud weight as the drilling mud and gas mixture flows up the annulus of the wellbore. The method may reduce or eliminate the need to install intermediate casings in the vertical section. A method for tripping out of the wellbore is also described herein.

Figure 1:
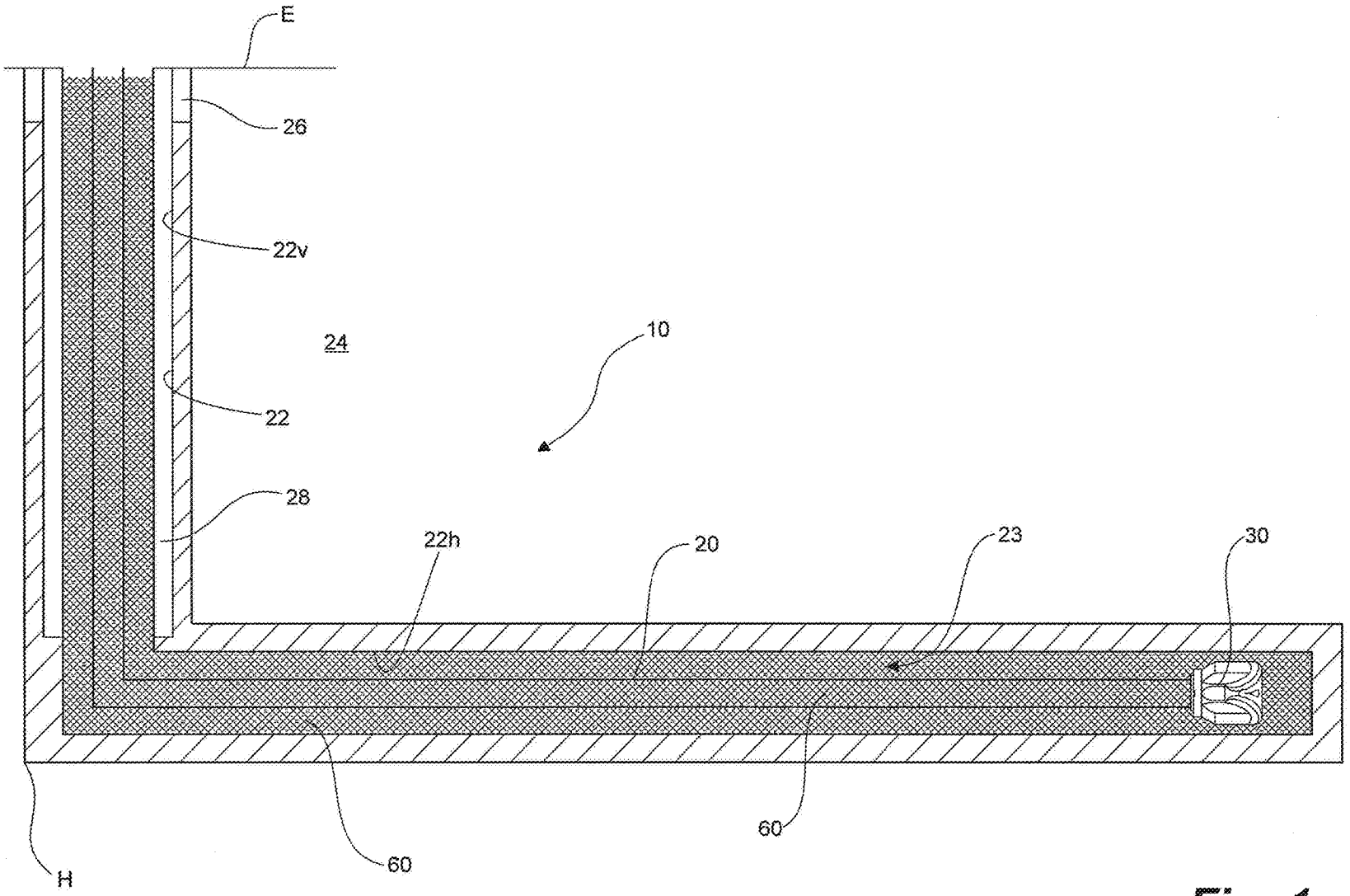
Fig. 1 Prior Art
FIG. 1 is a schematic view of a prior art drilling system, illustrating the basic downhole components thereof.

FIG. 1 illustrates a conventional system 10 for drilling a wellbore 22. The system 10 has a drill string 20 and a drill bit 30 at a distal end of the drill string 20. In the illustrated example, the wellbore 22 drilled by the drilling system has a vertical section 22*v* and a horizontal section 22*h* that are connected by a heel section H. As can be appreciated, the vertical section 22*v* may deviate from vertical and the horizontal section 22*h* may deviate from horizontal. The wellbore has a surface casing 26 that extends from surface E. When the wellbore is being drilled, drilling mud 60 is pumped into the drill string, exits the drill bit, and flows back uphole towards the surface E via the wellbore annulus 23 (i.e., the space between the inner surface of the wellbore 22 or the casing and the drill string). The drilling mud 60 may carry cuttings with it as the mud travels uphole.

Figure 2B:
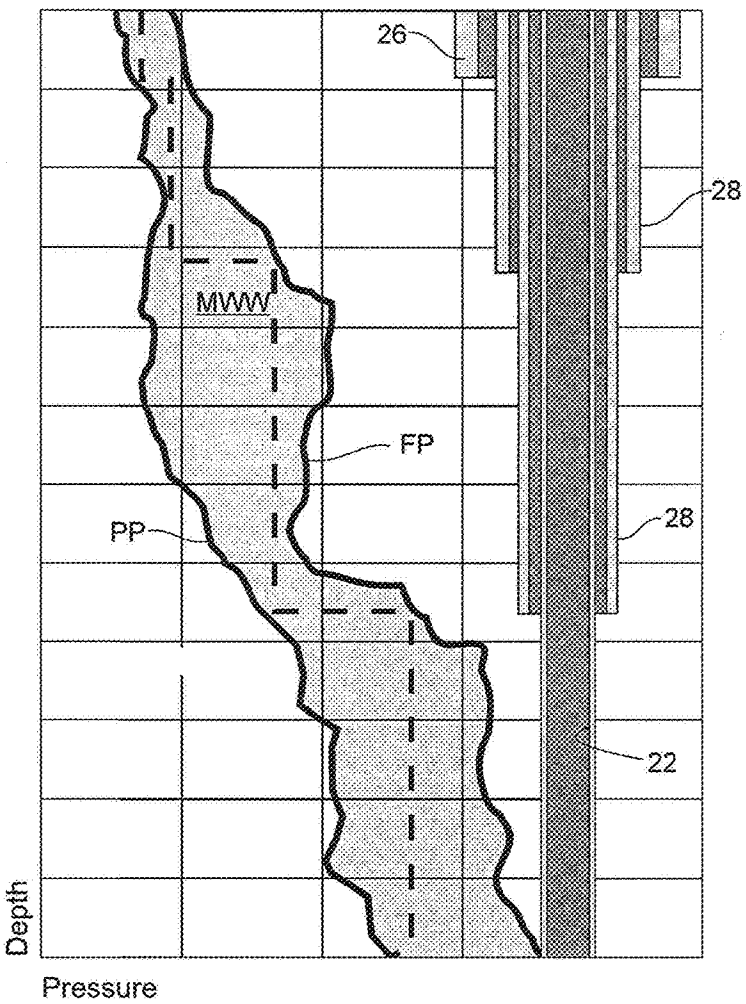
Fig. 2B Prior Art
FIG. 2B is a graph illustrating the relationship between pore pressure, fracture pressure, and placement of intermediate casings.
Figure 2A:
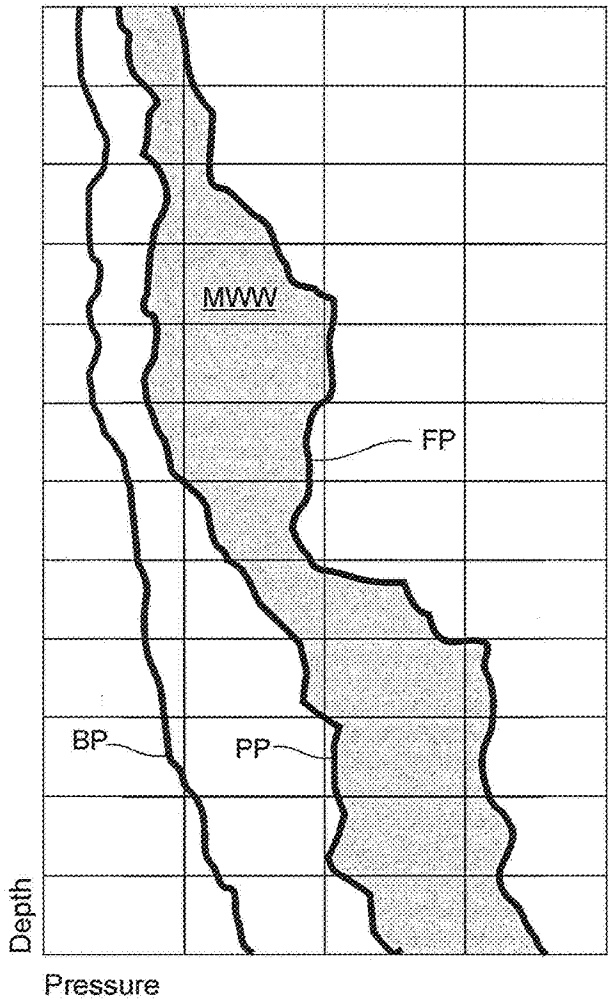
Fig. 2A Prior Art
FIG. 2A is a graph illustrating the relationship between mud weight window, pore pressure, and fracture pressure.

With further reference to FIGS. 2A and 2B, as drilling depth increases, the pore pressure and the fracture pressure of the subterranean formation also increase, which affects the boundaries of the MWW. In FIGS. 2A and 2B, the pore pressure and the fracture pressure are presented by lines PP and line FP, respectively. The breakout pressure of the wellbore is presented by line BP. The MWW is the area between lines PP and FP and the downward direction on the graph represents an increase in drilling depth. As drilling progresses deeper into the formation, the mud weight has to be increased to stay within the MWW, but the increased mud weight may exceed the fracture pressure of one or more strata around previously drilled uphole portions of the wellbore 22.

In the conventional drilling system 10, one or more intermediate casings 28 are installed to protect such strata (which may be referred to as "weak zones" 24) that are at shallower depths than the current drilling depth. In the illustrated example shown in FIG. 1, the horizontal section 22*h* is at a greater depth than the vertical section 22*v* so intermediate casing 28 is put in place in the vertical section 22*v* to isolate the weak zones 24 around the vertical section 22*v* from the drilling mud as the horizontal section 22*h* is being drilled.

Figure 3:
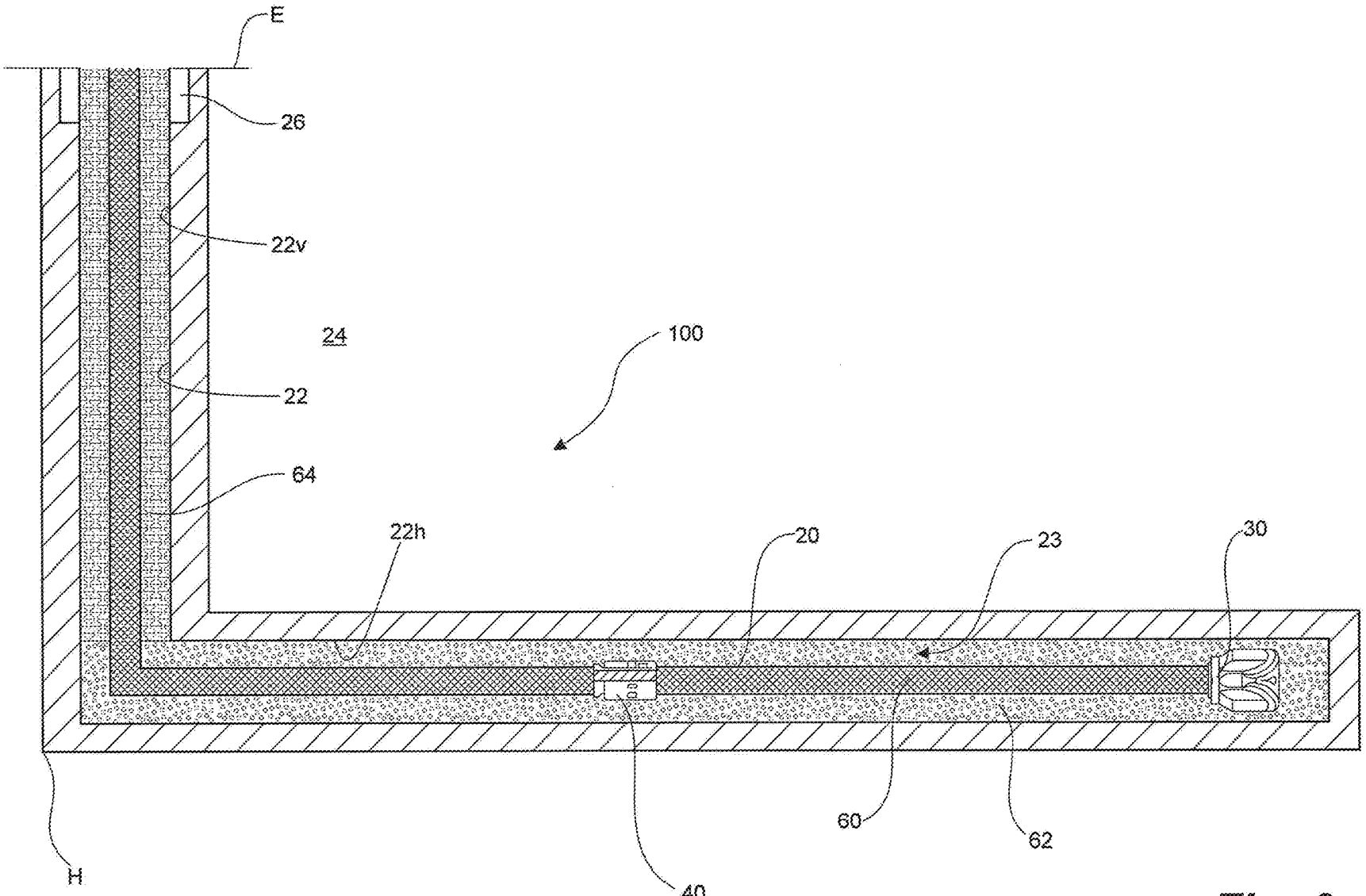
FIG. 3 is a schematic view of a drilling system according to one embodiment of the present disclosure.

FIG. 3 illustrates a drilling system 100 according to one embodiment of the present disclosure. In system 100, the vertical section 22*v* is drilled conventionally whereby single-phase drilling mud 60 is pumped down the drill string and the drilling mud is selected to have a mud weight within the MWW. As the drilling progresses to the horizontal section 22*h*, single-phase drilling mud 60 is still being pumped down the drill string 20 but the mud weight of the drilling mud is selected to be lower than the pore pressure of formation in the horizontal section 22*h*, which may be referred to as "flow drilling". While flow drilling, (i.e., when the mud weight of the drilling mud is lower than the pore pressure), an amount of gas is drawn into the wellbore annulus 23 from the formation and the gas is mixed with the drilling mud and drill cuttings in the annulus 23 to form a solution gas mixture 62. The solution gas mixture 62 flows in the uphole direction and as the solution gas mixture 62 reaches the vertical section 22*v*, the gas comes out of solution to form a two-phase mixture 64 consisting of drilling mud and gas. The gas coming out of solution causes a drop in the mud weight of the two-phase mixture 64. The amount of formation gas drawn into the wellbore 22 in the horizontal section 22*h* is controlled to achieve pressures in the vertical section 22*v* that are less than the fracture pressure of the weak zones 24. As a result, the drilling mud can return to surface E via the wellbore annulus 23 without fracturing the weak zones 24 in the vertical section 22*v*. This accordingly prevents uphole weak zones 24 from being fractured while managing deeper high-pressure zones with multiphase flow drilling, thereby reducing or eliminating the need for intermediate casings in the vertical section 22*v*.

Figure 4:
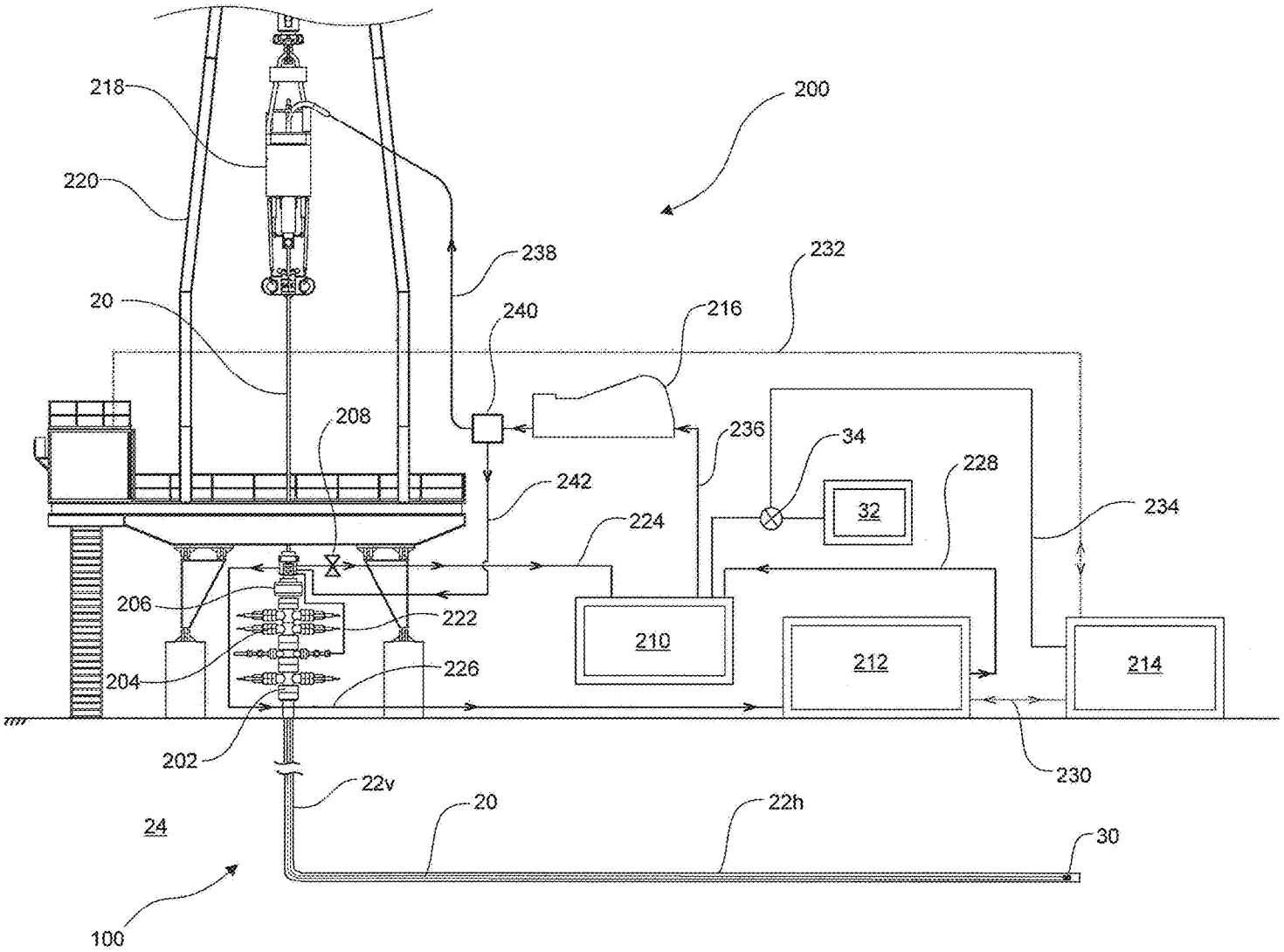
FIG. 4 is a schematic view of a managed pressure drilling system according to one embodiment of the present disclosure.
Figure 5:
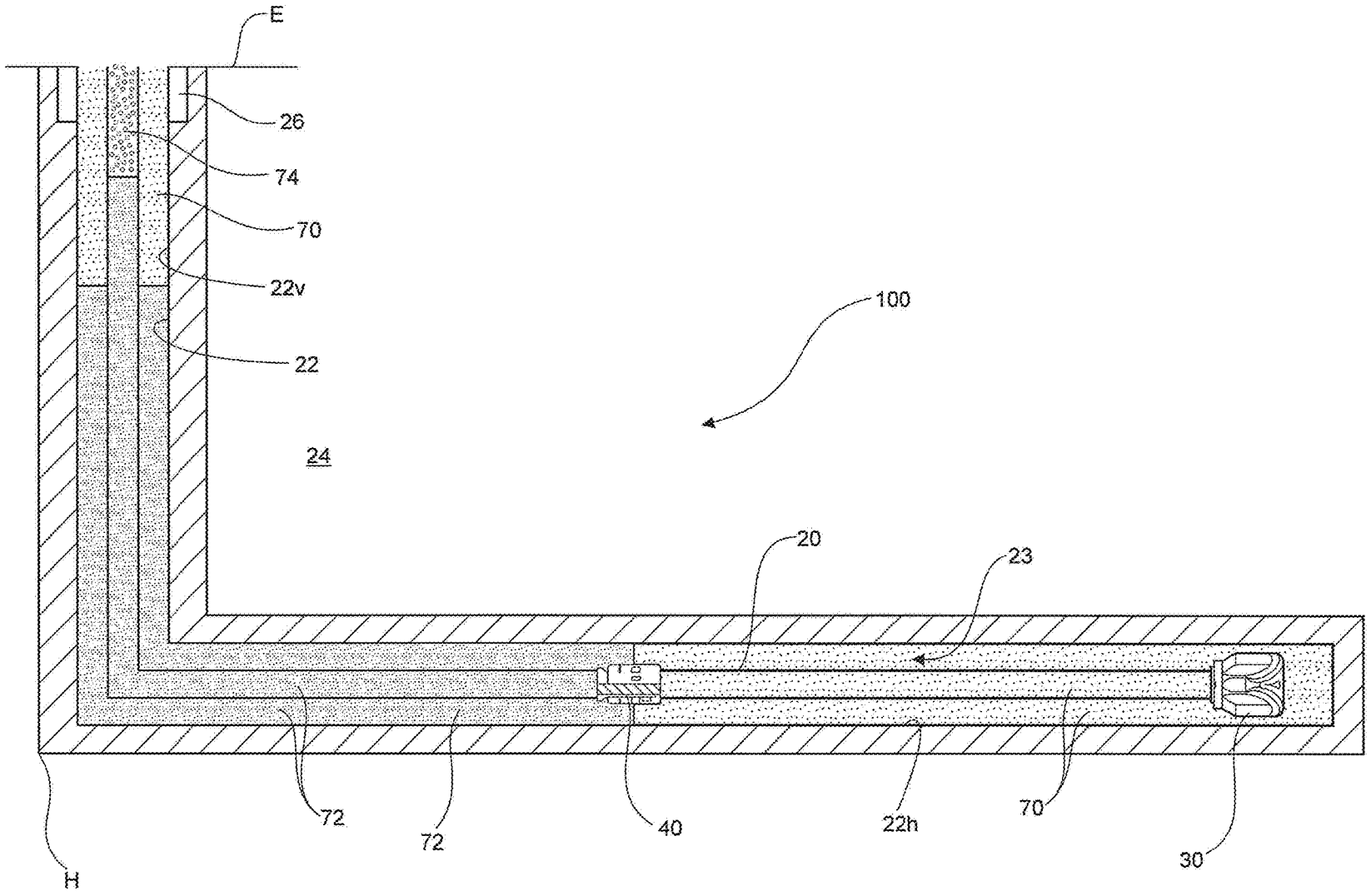
FIGS. 5 to 8 are schematic views of a wellbore, showing various positions of the drill string in a process of tripping out from the wellbore, according to one embodiment of the present disclosure.

In some embodiments, a managed pressure drilling (MPD) system is used in drilling the wellbore 22 and to control the amount of formation gas that enters the wellbore annulus 23 in the horizontal section 22*h*. In some embodiments, closing one or more drilling chokes in the MPD system reduces the amount of formation gas that enters the wellbore annulus 23. A sample MPD system 200 is shown in FIG. 4. System 200 includes a wellhead 202, a blowout preventer ("BOP") stack 204, a rotating control device ("RCD") 206, a shut off valve 208, mud handling equipment 210, an MPD manifold 212, an MPD control shack 214, a rig pump 216, a top drive 218 supported on a drilling rig 220, and the drill string 20. The wellhead 202 is located at the top or head of the wellbore 22 which penetrates one or more subterranean formations. The BOP stack 204 is operably coupled to the wellhead 202 to prevent blowout, i.e., the uncontrolled release of formation fluids and/or gasses from the wellbore 22 during drilling operations. The drill bit 30 is operably coupled to the drill string 20 and extends within the wellbore 22. The drill string 20 extends into the wellbore 22 through the BOP stack 204 and the wellhead 202. Moreover, the RCD 206 is operably coupled to the BOP stack 204, opposite the wellhead 202, and forms a friction seal around the drill string 20. The wellhead 202 is fluidly connected to the RCD 206 via an equalization line 222.

The mud handling equipment 210 may include variety of apparatus, such as, for example, separator tanks, shakers and mud tanks. It can be appreciated that the apparatus to be used in equipment 210 may vary depending on drilling needs. In this example embodiment, the mud handling equipment 210 operates to process the two-phase mixture that has been returned to surface from the wellbore annulus 23. The mud handling equipment 210 may include a gas-liquid separator for separating gas and drilling mud, a mud tank (not shown) for collecting the separated drilling mud, and a flare 32 for burning off the separated gases. In some embodiments, the gas-liquid separator is a pressure-rated vessel since the flow rate of the gas flowing to surface is higher during flow drilling than that during conventional drilling (i.e., where the mud weight of the drilling mud is within the MWW). For flow drilling, the gas-liquid separator is configured to accommodate higher flow rates and pressures. In some embodiments, a gas flowmeter 34 is positioned at and operably coupled to the inlet of the flare 32 to measure the amount of gas entering the flare. The mud handling equipment 210 is also operably coupled to, and in fluid communication with, the RCD 206 via the shutoff valve 208 and a low-pressure mud return line 224. The MPD manifold 212 comprises one or more drilling chokes (not shown) and is operably coupled to, and in fluid communication with, the RCD 206 via a high pressure MPD line 226. The MPD manifold 212 is also operably coupled to, and in fluid communication with the mud handling equipment 210 via a low-pressure MPD line 228. The MPD control shack 214 is operably coupled to, and in communication with, the MPD manifold 212 via a communication line 230. The MPD control shack 214 comprises one or more processors for controlling the MPD manifold 212. The MPD control shack 214 is also operably coupled to, and in communication with, the drilling rig 220 via a communication line 232 to allow the MPD control shack 214 to receive data from the rig 220. The MPD control shack 214 may be operably coupled to, and in communication with, the gas flowmeter 34 via a communication line 234 to allow the MPD control shack 214 to receive data from the gas flowmeter 34.

The mud handling equipment 210 is operably coupled to, and in fluid communication with, the rig pump 216 via a pump suction line 236. The rig pump 216 is operably coupled to, and in fluid communication with, the top drive 218 via a mud pump line 238. The top drive 218 is operably coupled to the drill string 20 and the top drive 218 is configured to control the drill string 20.

Drilling system 200 may include a flow diverter 240 that is operably coupled to, and in fluid communication with, the top drive 218, the rig pump 216, and the RCD 206. The flow diverter 240 is positioned along the mud pump line 238 and fluidly communicates with the RCD 206 via a flow diverter line 242. The flow diverter 240 operates to redirect rig pump flow from the top drive 218 and drill string 20 to the RCD 206 and MPD manifold 212 to allow continuous fluid circulation during drill pipe connection to maintain the desired pressure in the wellbore 22.

Figure 11A:
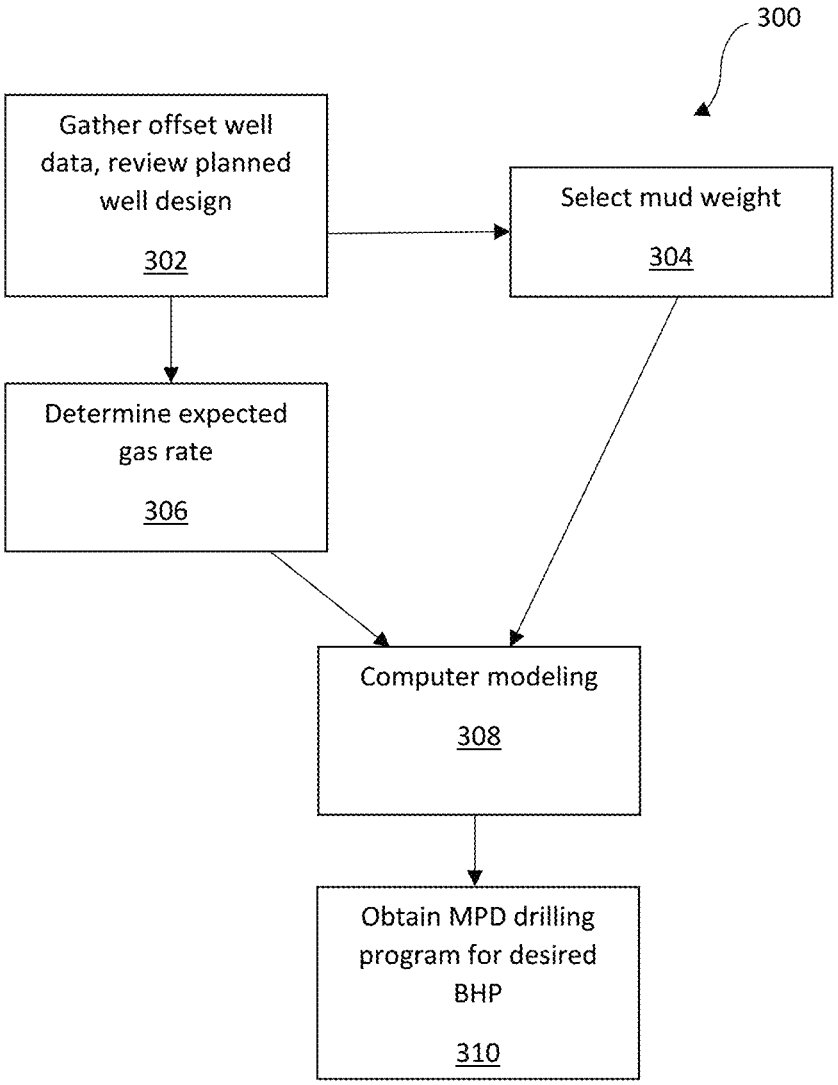
FIG. 11A is a flowchart illustrating an exemplary process for obtaining a drilling program, according to one embodiment.

FIG. 11A illustrates a method 300 for planning the MPD drilling program for a wellbore prior to the actual drilling. The method 300 begins with the gathering of offset well data and/or reviewing of the planned well design (step 302). Step 302 may involve reviewing a "stick diagram" which may include information such as, e.g., geomechanics data, drilling fluid hydraulics, borehole imaging, and formation evaluation data. Based on the information and data at step 302, a mud weight is selected (step 304) and the expected gas flow rate of the formation is determined (step 306). Since the pore pressure and fracture pressure are not known prior to drilling, the selected mud weight is an estimate, which is usually based on the mud density value in the stick diagram. The expected gas rate and the selected mud weight are inputted into a computer model (step 308). The computer model then generates a model for achieving the desired bottomhole pressure (BHP) in the weak zones 24 (step 310), which is then used to create the MPD drilling program. The mud weight for achieving the desired BHP according to the resulting model may differ from the selected mud weight.

Figure 11B:
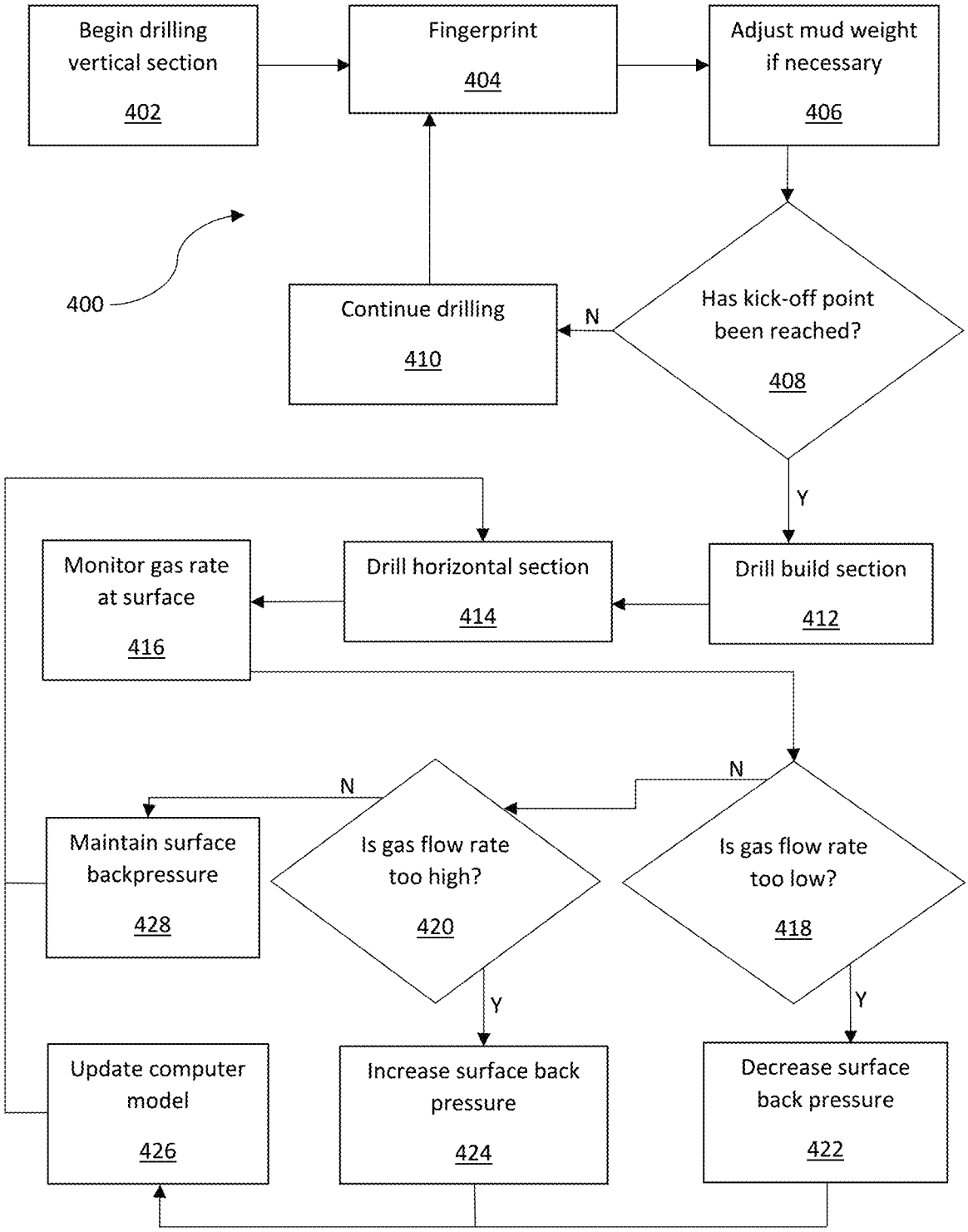
FIG. 11B is a flowchart illustrating an exemplary process for drilling a wellbore, according to one embodiment.

With reference to FIG. 4, the drilling system 200 is used to extend the reach or penetration of the wellbore 22 into the one or more subterranean formations. To this end, the drill string 20 is rotated, and weight-on-bit is applied to the drill bit 30, thereby causing the drill bit 30 to rotate against the bottom of the wellbore. At the same time, the rig pump 216 circulates drilling mud to the drill bit, via the drill string 20. The drilling mud is discharged from the drill bit 30 into the wellbore to clear away drill cuttings from the drill bit. FIG. 11B illustrates a method 400 for drilling a wellbore 22 based on the MPD drilling program. At step 402, the drilling of the vertical section 22*v* is started. While drilling, "fingerprinting" is continuously or periodically performed in real-time using dynamic formation integrity tests (DFITs) to determine the fracture pressure of the section of the wellbore 22 that is currently being drilled, to in turn determine the optimum mud weight and equivalent mud weights for drilling the next section of the wellbore 22 (step 404). If the current mud weight is not the same as the optimum mud weight, the current mud weight is adjusted (step 406). If the predetermined kick-off point has not been reached (step 408), the drilling of the vertical section 22*v* continues (step 410) and fingerprinting is performed as before (step 404). If the predetermined kick-off point has been reached (step 408), then the drilling of the build section begins (step 412). The drilling of the horizontal section 22*h* begins when the drilling of the build section is completed (step 414).

With reference to FIG. 3, when drilling the horizontal section, the mud weight is selected to be below the pore pressure of the formation ("flow drilling"), such that some hydrocarbon gas from the formation is released into the wellbore annulus 23. The released gas and drill cuttings are mixed with the drilling mud to form a solution gas mixture 62 and the solution gas mixture 62 flows up the wellbore annulus 23. As the solution gas mixture 62 of drilling mud, cuttings, and gas travel up the wellbore 22, the gas comes out of solution in the previously-drilled vertical section 22*v* of the wellbore, and the solution gas mixture 62 becomes a two-phase mixture 64, which has a lower equivalent mud weight than the solution gas mixture 62. The result is lower BHP in the vertical section 22*v* than if no formation gas is released into the wellbore 22.

With reference to FIGS. 3 and 4, from the wellbore annulus 23, the two-phase mixture 64 flows into the RCD 206 through the wellhead 202 and the BOP stack 204. The RCD 206 sends the flow of the two-phase mixture 64 to the MPD manifold 212 while preventing communication between the wellbore annulus 23 and the atmosphere. In this manner, the RCD 206 enables the drilling system 200 to operate as a closed-loop system. The MPD manifold 212 receives the two-phase mixture 64 from the RCD 206 and is adjusted as necessary to maintain the desired backpressure within the wellbore 22. The mud handling equipment 210 receives the two-phase mixture 64 from the MPD manifold 212. The mud handling equipment 210 captures and separates the gas and removes the drill cuttings from the two-phase mixture 64 to recover the drilling mud. The recovered drilling mud exiting the mud handling equipment 210 is recirculated by the rig pump 216 to the drill bit 30, via the drill string 20. The separated gas is sent to the flare 32 and the flow rate of the separated gas entering flare 32 is measured by the gas flowmeter 34.

From the DFITs performed while drilling the vertical section 22*v*, the lowest fracture pressure in the weak zones 24 is known. Accordingly, the mud weight for the drilling the horizontal section 22*h* is selected such that the resulting BHP in the vertical section 22*v*, due to the two-phase mixture 64, is below the lowest fracture pressure in the weak zones 24. Initially, the flow drilling mud weight for the horizontal section 22*h* can be calculated based on the formation pressure from previous drilling data of the same formation. If the wellbore is the first one to be drilled in a formation (i.e., no previous drilling data is available), the flow drilling mud weight can be estimated by the region hydrostatic gradient and/or obtained experimentally by fingerprinting and monitoring the flow of the gas into the wellbore 22, which can be done using the gas flowmeter 34 at surface.

Referring back to FIG. 11B, as the drilling of the horizontal section 22*h* progresses, the gas flow rate is measured and monitored by the gas flowmeter 34 (step 416). Based on the gas flow rate measured by gas flowmeter 34, the control shack 214 can determine, by reverse calculation, the BHP in the vertical section 22*v*. If the calculated BHP in the vertical section 22*v* is too high (i.e., higher than the lowest fracture pressure of the weak zones 24), it means that the gas flow rate is too low to achieve the desired BHP in the vertical section 22*v* (step 418). If the calculated BHP in the vertical section 22*v* is too low (i.e., lower than the highest pore pressure of weak zones 24), it means that the gas flow rate is too high to achieve the desired BHP in the vertical section 22*v* (step 420).

The pressure P at any depth in the wellbore can be calculated as described below. For simplicity, the calculations herein are based on steady state conditions and incompressible liquid phase. The pressure P at any given time at a particular depth in the wellbore annulus 23 is:

$$P=SBP+P_H+P_F \quad \text{(EQ-1)}$$

where SBP is surface backpressure, $P_H$ is hydrostatic pressure at the particular depth, and $P_F$ is frictional pressure losses ("frictional losses"). SBP can be measured at the surface. $P_H$ and $P_F$ can be determined based on parameters such as well profile, drill string components, drilling fluid properties and profile in the wellbore, the phases of the returned drilling fluid to the surface, and the flow rate, viscosity, temperature, and density of each phase of the returned drilling fluid, etc. The returned drilling fluid may be single-phase (where no gas is entering the wellbore) or two-phase (where gas is entering the wellbore and flowing with the drilling mud at the same time). Where returned drilling fluid is two-phase, the drilling fluid contains liquid (i.e., the drilling mud) and gas, which can be separated from one another at surface, as described above.

Figure 12:
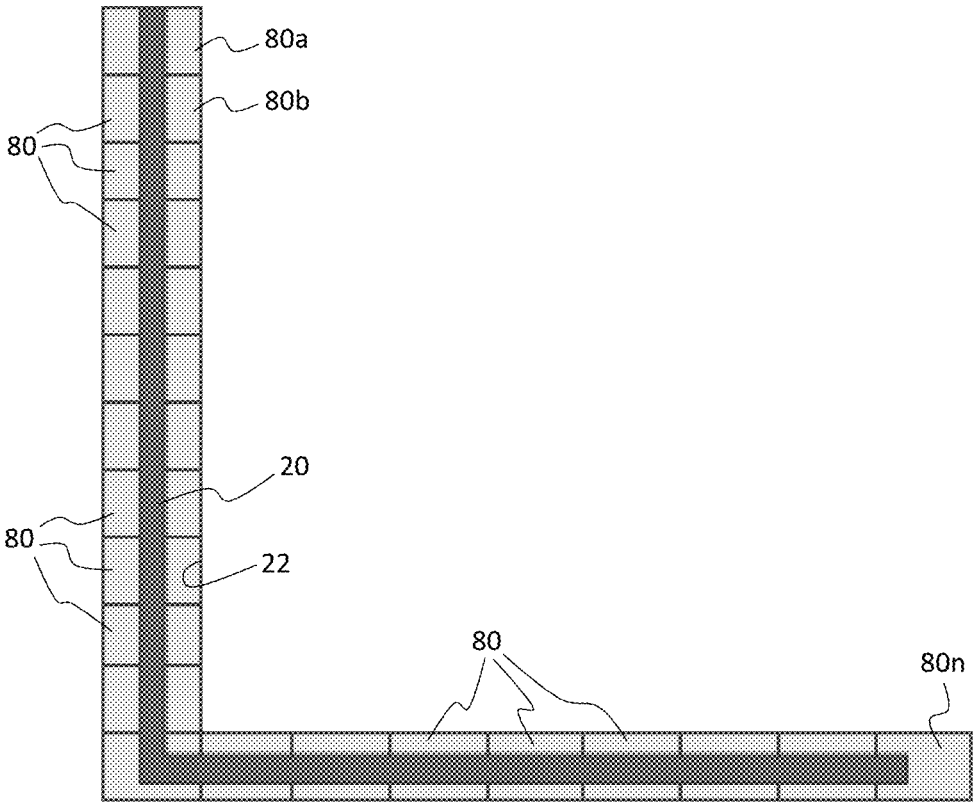
FIG. 12 is a schematic representation of a wellbore wherein its length is divided into a plurality of grids.

In some embodiments, to calculate the pressure profile inside the wellbore 22, the well length is first divided into a plurality of smaller axial sections 80 ("grids") as shown for example in FIG. 12. To determine the pressure P in the first grid 80*a* closest to surface, in embodiments where the returned drilling fluid is two-phase, parameters such as SBP, flow rate, temperature, density, and viscosity of the liquid in the two-phase drilling fluid, and flow rate and temperature of the gas in the two-phase drilling fluid can be measured at surface, while other parameters such as density and viscosity of the gas in the two-phase drilling fluid can either be measured at surface or calculated by available correlations. In one example, the gas density of the gas in the two-phase drilling fluid can be calculated using the following equation:

$$\rho_g = \frac{PMW}{ZRT} \quad \text{(EQ-2)}$$

where $\rho_g$ is gas density, P is the pressure in EQ-1, MW is gas molecular weight, Z is a gas compressibility factor, R is the universal gas constant, and T is the absolute grid temperature. The gas compressibility factor Z can be evaluated through various equation of state (EoS) correlations like Peng-Robinson (PR) or Soave-Redlick-Kwong (SRK). For PR EoS, for example, gas compressibility factor Z can be estimated by solving EQs-3 to 9 below:

$$Z^3-(1-B)Z^2+(A-2B-3B^2)Z-(AB-B^2-B^3)=0 \quad \text{(EQ-3)}$$

$$A=\frac{a\alpha P}{R^2T^2} \quad \text{(EQ-4)}$$

$$B=\frac{bP}{RT} \quad \text{(EQ-5)}$$

$$a=0.45724\frac{R^2T_c^2}{P_c} \quad \text{(EQ-6)}$$

$$\alpha=\left(1+k\left(1-\left(\frac{T}{T_c}\right)^{\frac{1}{2}}\right)\right)^2 \quad \text{(EQ-7)}$$

$$b=0.07780\frac{RT_c}{P_c} \quad \text{(EQ-8)}$$

$$k=0.37464+1.54226\omega-0.26992\omega^2 \quad \text{(EQ-9)}$$

where $T_c$ is the critical temperature, $P_c$ is the critical pressure, and ω is the acentric factor. $T_c$, $P_c$ and co are specific to each gas type and can be found in tables of thermodynamic properties. First, the values of $T_c$, $P_c$ and ω along with the universal gas constant R are used in EQs-6, 8, and 9 to calculate a, b, and k, respectively. Next, the intermediary parameter a is calculated using EQ-7. Finally, the parameters of Peng-Robinson equation of state, A and B, are determined using EQs-4 and 5, respectively. After substituting A and B into EQ-3, a cubic polynomial is obtained which can be solved for the gas compressibility factor Z. From EQ-2, the gas compressibility factor Z is used to determine the gas density $\rho_g$, which in turn is used to determine $P_H$ and $P_F$.

At any given time, starting from the first grid 80*a*, and going sequentially from one grid 80 to the next in the downhole direction, the values for pressure and temperature are calculated in order to estimate the fluid properties, flow type, and flow regime in the wellbore 22. For example, the temperature in each grid 80 can be determined based on the temperature gradient of the well, or more accurately based on the thermal properties of the well and the surrounding rock. As known to those skilled in the art, the temperature gradient may be estimated from typical geothermal gradient of the area of the well and the thermal properties may be estimated based on the rock lithology, all of which can be determined from historical data of previously drilled well in the same area.

The average pressure of each grid ($P_j$) can be determined through an iteration loop as:

$$P_j^i=P_{j-1}^i+P_{H_{j-1\to j}}^{i-1}+P_{F_{j-1\to j}}^{i-1} \quad \text{(EQ-10)}$$

where $P_j^i$ is the average pressure of the current grid at the ith iteration, $P_{j-1}^i$ is the average pressure at the previous depth of the previous grid, $$P_{H_{j-1\to j}}^{i-1}$$

is the hydrostatic pressure taking into account the increase in depth from the previous grid to the current grid, and $$P_{F_{j-1\to j}}^{i-1}$$

is the annular pressure loss which can be set at zero for the first iteration (i.e. i=1). Then, with the assumed initial grid average pressure ($P_j^i$) and temperature, the values of gas volume, gas density (for example, using EQs 2 to 9), gas viscosity, and gas velocity can be determined as described above, and likewise, the parameters of the liquid phase can be also determined. Then, with a more accurate estimation of the parameters with the updated average pressure (PI), more accurate $$P^i_{H_{j-1\to j}} \text{ and } P^i_{F_{j-1\to j}}$$

values can be calculated and a newer, more accurate grid average pressure ($P_j^{i+1}$) can be calculated.

This iterative process continues several times from the top grid 80*a* to the lowermost grid 80*n* ("toe grid") until the maximum difference between two consecutive calculated pressures for the same grid is smaller than a predetermined tolerance E:

$$|p_j^{i+1}-p_j^i|\leq\epsilon \quad \text{(EQ-11)}$$

Once the iterative process for that given time (as per one second (1 s) time intervals) is completed, all the properties of the grids 80*a* to 80*n* are set, and calculations can begin for the next timestep.

Using the above-described process, the pressure, temperature, and other parameters can be calculated at each timestep for all the grids 80 sequentially starting from the grid 80*a* closest to surface all the way down to the toe grid 80*n* of the wellbore. Then, when the properties of all the grids are determined, a material balance validation can be performed to validate the accuracy of the calculated property values of that timestep. For example, volume calculations can be validated based on the annular volume of the wellbore (i.e., cross-sectional area×length of the wellbore), as the total of the gas volumes and liquid volumes of all the grids 80 should be equal to the annular volume.

The above-described process can be repeated to obtain the pressure and temperature profile inside the wellbore in real-time, as time progresses. Accordingly, referring back to FIG. 11B, if the pressure at any depth along the weak zones 24 is close to or above the fracture pressure (i.e., the gas flow rate at surface is too low) (step 418), one or more of the drilling chokes of the MPD manifold 212 can be opened to reduce the surface backpressure (step 422), thereby increasing the amount of formation gas being released into the wellbore. The increase of gas in the wellbore changes the dynamics of the flow of the resulting two-phase mixture 64 by reducing the hydrostatic pressure and increasing the frictional losses. Likewise, if the pressure along the weak zones 24 is close to or below the pore pressure (i.e., the gas flow rate is too high) (step 420), one or more of the drilling chokes of the MPD manifold 212 can be closed to increase the surface backpressure (step 424), thereby decreasing the amount of formation gas being released into the wellbore. The decrease of gas in the wellbore increases the hydrostatic pressure and decreases the frictional losses. If the surface backpressure is modified, the computer model for calculating the pressure profile may be updated accordingly (step 426), for example with updated well parameters such as depths and/or inclinations, gas rate, mud properties such as mud weight and/or mud rheology, etc. If the pressure in the weak zones 24 is within the MWW (i.e., the gas flow rate is not too high or too low), the surface backpressure is maintained (step 428). Drilling may continue whether the surface backpressure is changed or maintained (step 414).

In some embodiments, a new pressure profile is calculated after any change in the surface backpressure, based on the gas flow rate measured at surface (step 416), to determine whether the gas flow rate is too high or too low (steps 418 and 420), and one or more of the chokes of MPD manifold 212 can be adjusted accordingly as necessary, as described above. In some embodiments, a few minutes after any adjustment to the surface backpressure, steady state condition in the wellbore is reached such that the pressure profile inside the wellbore remains substantially constant provided operation parameters are not changed.

With reference to FIGS. 5 to 8, the drill string 20 comprises a circulation sub 40 positioned at some distance from the drill bit 30 at the distal end. The circulation sub 40 has a closed position in which fluid communication between the inner bore of the drill string 20 and the wellbore annulus 23 via the circulation sub 40 is restricted; and an open position in which fluid communication between the inner bore of the drill string 20 and the wellbore annulus 23 via the circulation sub 40 is permitted. During drilling, the circulation sub 40 is in the closed position. In some embodiments, to trip out of the well, the circulation sub 40 is placed in the open position, and a predetermined amount of heavy mud 72 is pumped down the drill string 20 and is permitted to flow out into the wellbore annulus 23 via the circulation sub 40, as described in more detail below. In some embodiments, an amount of air 74 may be in the drill string 20, above the heavy mud 72 that has been introduced into the drill string 20.

Figure 11C:
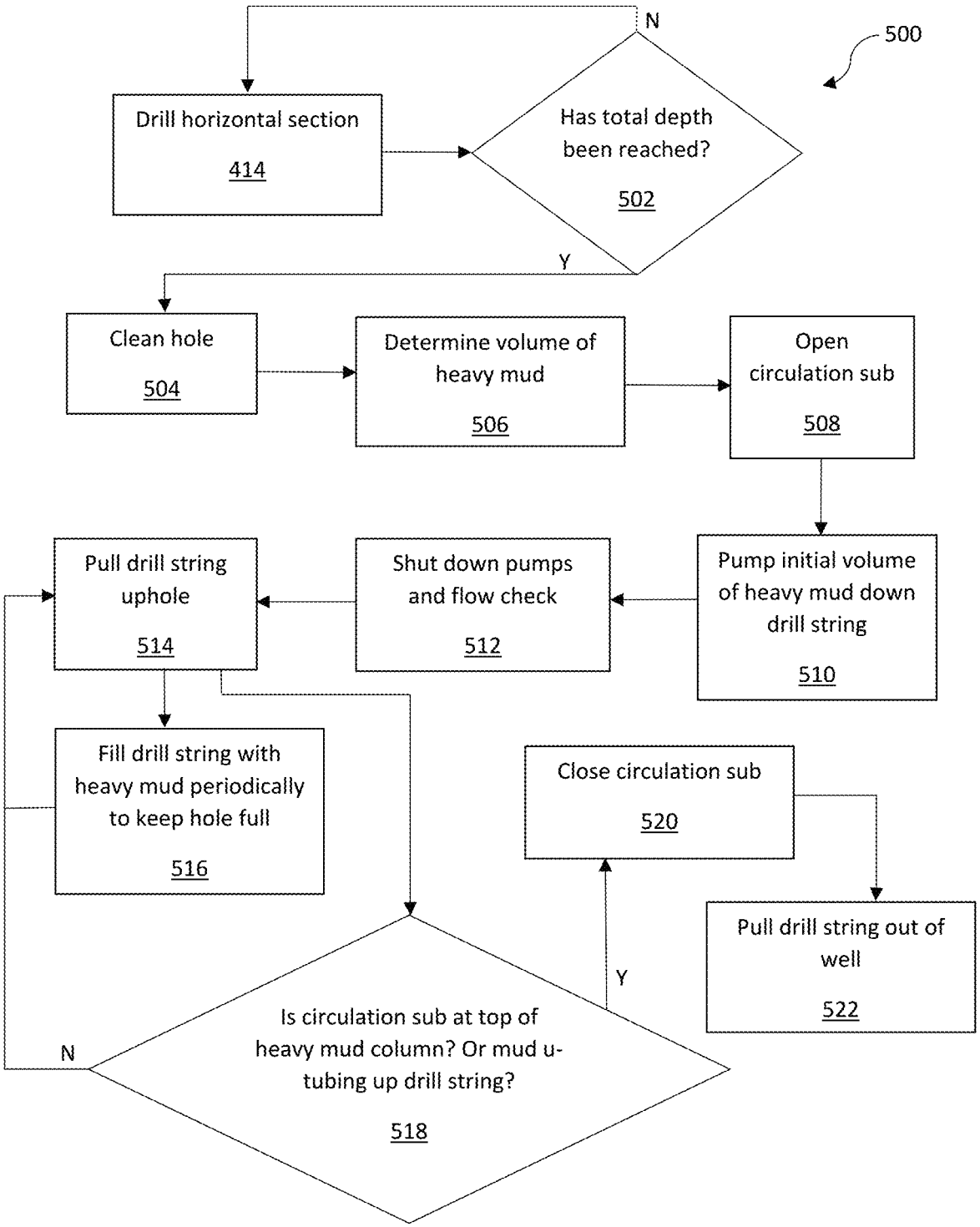
FIG. 11C is a flowchart illustrating an exemplary process for tripping out of a wellbore, according to one embodiment.

FIG. 11C illustrates a method 500 for tripping out of the wellbore 22 that has been drilled according to the above-described method. With reference to FIGS. 5 to 8 and 11C, the drilling of the horizontal section 22*h* continues (step 414) until the total depth of the wellbore has been reached (step 502). Once the total depth has been reached, the wellbore 22 is cleaned out using light mud 70 (step 504). The mud weight of the light mud 70 is less than that of the heavy mud 72.

The amount of heavy mud 72 (also referred to as "kill mud") required to be placed in the well is determined (step 506). In some embodiments, the mud weight of the heavy mud 72 ("kill mud density $\rho_k$") can be calculated by:

$$\rho_k = \frac{P_r - P_w}{g \times \Delta d} \quad \text{(EQ-12)}$$

where $P_r$ is the reservoir pressure in the horizontal section 22*h*, $P_w$ is the light mud hydrostatic pressure, g is the gravity constant, and Δd is the true vertical depth (TVD) difference between the weak zone 24 and the heel H of the wellbore. At step 506, the amount of heavy mud 72 required may be determined by first determining the kill depth $d_k$, which is the planned depth of the circulation sub 40:

$$d_k = d_h + \left(\frac{\left(\left(\frac{\Pi}{4}\left(D_{OH}^2 - D_{PC}^2\right)\right) \times (d_{td} - d_h)\right)}{\frac{\Pi}{4} D_{OH}^2}\right) \quad \text{(EQ-13)}$$

where $D_{OH}$ is the open-hole diameter, $D_{PC}$ is the outer diameter of a casing to be placed into the wellbore 22 (i.e., casing 50 described below with reference to FIG. 10), $d_{td}$ is the total depth (i.e., the measured depth or "mD") of the well, $d_h$ is the heel depth (mD) of the well.

Then, the initial volume of kill mud $V_k$ that is required can be determine by:

$$V_k=(d_k-d_w)\times(A_a+A_i+A_m) \quad \text{(EQ-14)}$$

where $A_i$ is the cross-sectional of the drill string inner bore, $A_m$ is the cross-sectional area of the drill string wall, $d_w$ is the weak zone depth (mD), $A_a$ is the cross-sectional area of the wellbore annulus 23.

At step 508, the circulation sub 40 is opened and the initial volume of heavy mud $V_k$ determined using EQ-14 is pumped down the drill string 20 (step 510). Then, surface pumps (not shown) are shut down and flow check is performed to ensure that the well is killed (step 512). At step 514, the drill string 20 and drill bit 30 are pulled uphole. As the drill string 20 and drill bit 30 are being pulled uphole, the circulation sub 40 is left in the open position so that heavy mud 72 in the inner bore of the drill string above the circulation sub 40 continues to drain into the wellbore annulus 23.

Figure 6:
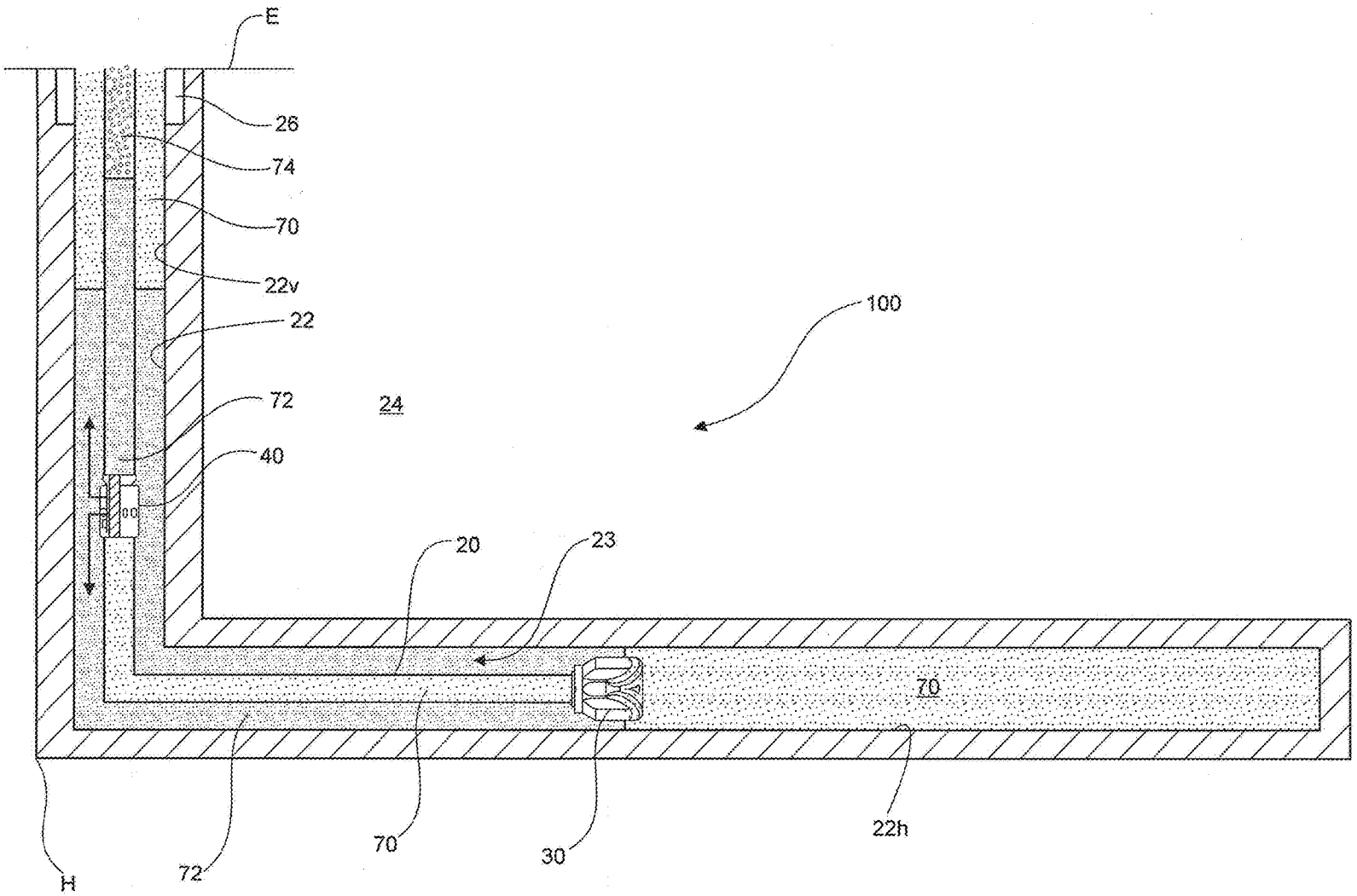
Figure 7:
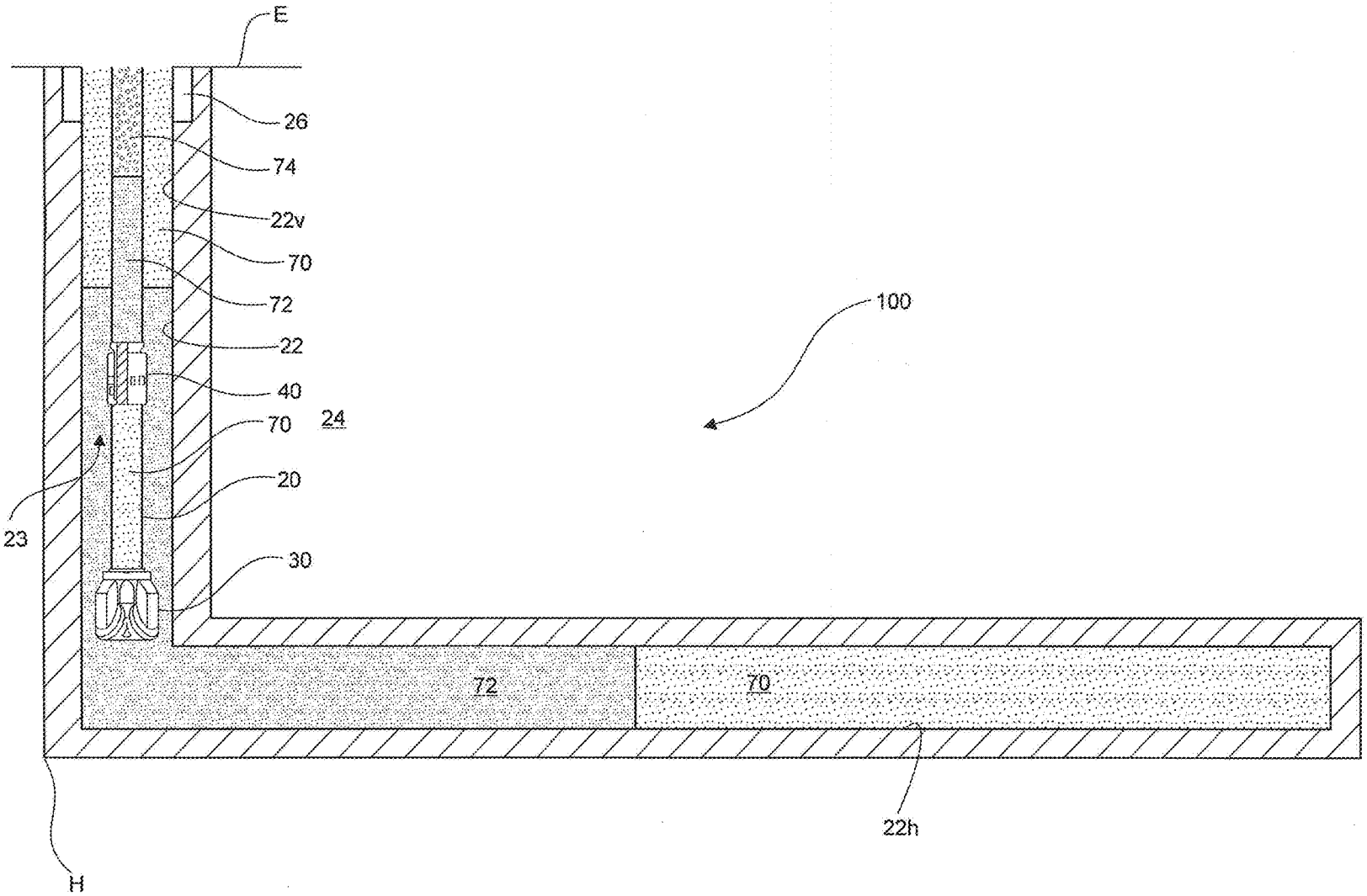
Figure 8:
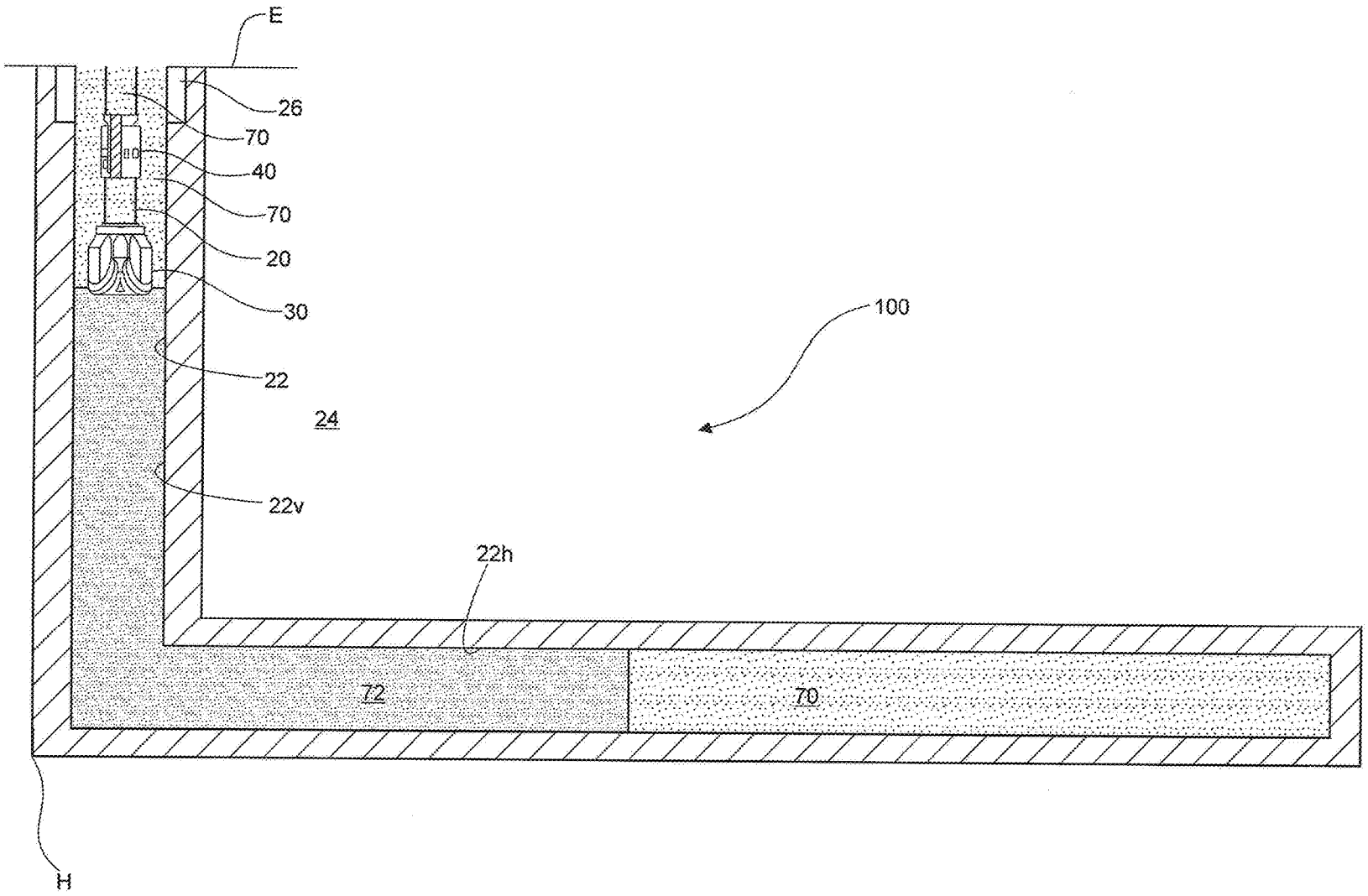

Further, as best shown in FIGS. 6 to 8, the drill string 20 is filled with additional volumes of heavy mud 72 periodically to fill the void left behind by the drill string 20 and the drill bit 30 in the wellbore 22 as the drill string 20 and drill bit 30 are moved uphole (step 516). As the drill string 20 is being pulled uphole, it is constantly checked whether the circulation sub 40 is at the top of the column of heavy mud 72 (FIG. 8) or whether mud is coming back up the inner bore of the drill string 20 (step 518). The position of the circulation sub 40 can be checked by comparing the distance the drill sting 20 has been pulled uphole and the top of the column of heavy mud 72 based on volumetric calculations. When either scenario happens, the circulation sub 40 is closed (step 520) and the drill string 20 and the drill bit 30 can then be fully removed from the wellbore 22 as shown in FIG. 9 (step 522).

Figure 9:
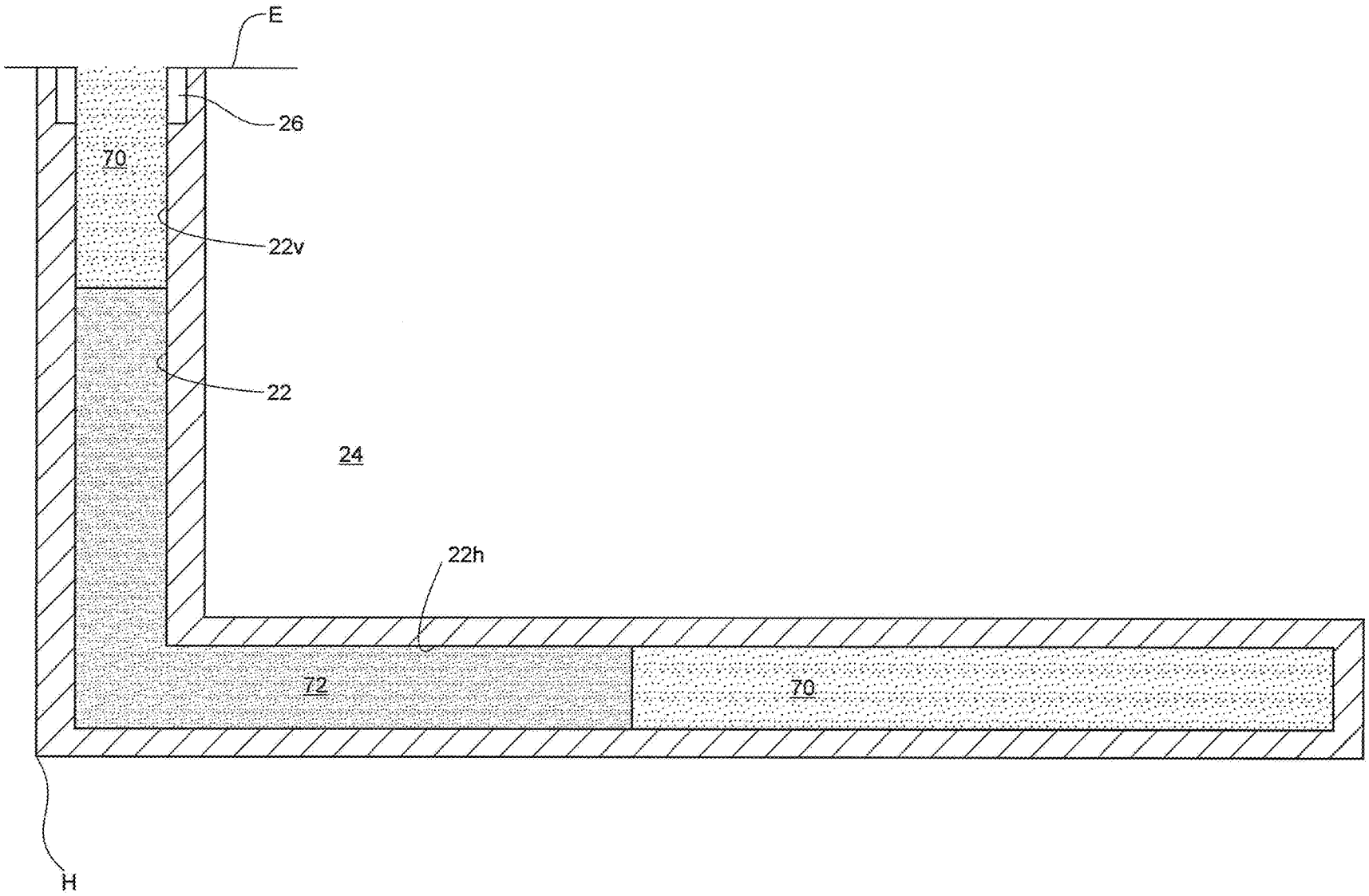
FIG. 9 is a schematic view of the wellbore of FIGS. 5 to 8, after the drill string has been removed from the wellbore.

With reference to FIG. 9, after the drill string 20 and drill bit 30 are removed from the wellbore 22, the column of heavy mud 72 remains in the wellbore 22 to prevent the flow of formation fluids (FIG. 9). No matter the mud density of the heavy mud 72, the ratio of light mud 70 and heavy mud 72 in the vertical section **22*v***, based on the above calculations, is such that the resulting pressure is within the MWW of the weak zones, thereby killing the well without compromising the wellbore's stability.

Figure 10:
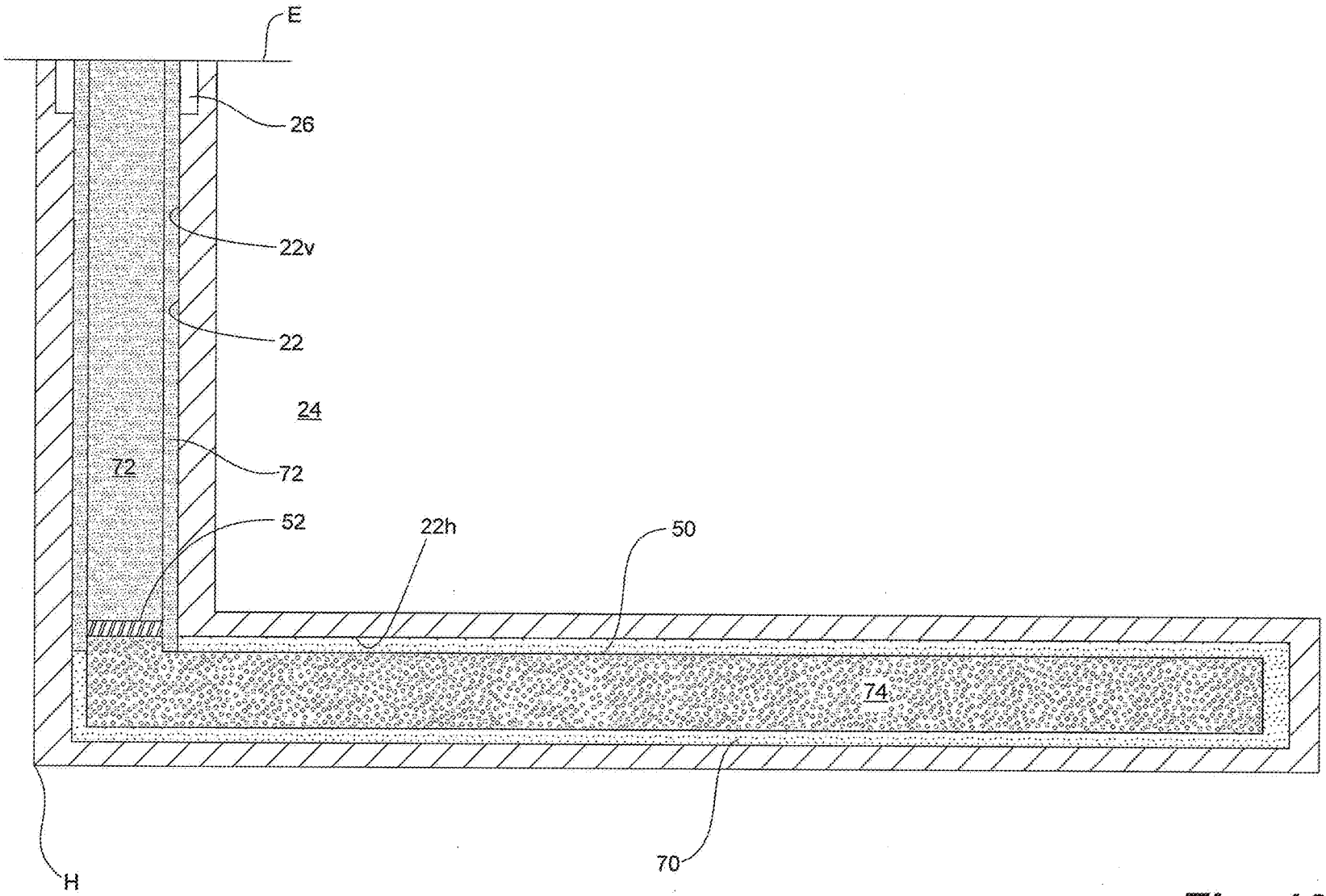
FIG. 10 is a schematic view of the wellbore of FIG. 9, with a floating casing disposed in the wellbore.

In some embodiments, with reference to FIG. 10, after the well is killed, a casing 50 can be floated into the wellbore 22. In some embodiments, when the floating casing 50 is placed downhole, the heavy mud 72 in the wellbore is displaced by the floating casing 50 and is confined within the vertical section **22*v* of the wellbore. As known to those skilled in the art, a casing flotation sub 52 may be used in the floating casing 50 to help prevent the casing 50 from dragging on the inner surface of the horizontal section 22*h*. In some embodiments, the casing flotation sub 52 is positioned in the floating casing 50 such that when the casing 50 is fully extended into the wellbore 22, the casing flotation sub 52 is at or near the heel H. In some embodiments, the floating casing 50 is filled with air 74 below the casing flotation sub 52. In some embodiments, the portion of the floating casing 50 extending in the horizontal section 22*h* is substantially surrounded by the light mud 70 in the wellbore 22**.

In some embodiments, the above-described systems and methods may reduce drilling time by about 50% or more because flat time associated with running intermediate casings is reduced or eliminated. Further, the two-phase mixture 64 in the horizontal section **22*h* of the wellbore 22 may reduce the differential pressure at the drill bit, which may improve the performance and longevity of the drill bit 30, thereby reducing the frequency of drill bit 30 replacement and thus minimizing the number of round trips of the drill string 30. As a result, the above-described systems and methods may significantly reduce the time and cost associated with wellbore drilling operations. Furthermore, by flow drilling in the horizontal section 22*h*, formation damage may also be reduced because it is less likely for drilling mud to plug up pores at the inner surface of the wellbore 22**.

It can be appreciated that the systems and methods described herein may also be applied when drilling wells that do not have a horizontal section, to eliminate or reduce the need to install intermediate casing sections in relatively shallower sections surrounded by weak zones. In such an example embodiment, a first, or shallower section can be drilled conventionally whereby single-phase drilling mud is pumped down the drill string and the drilling mud is selected to have a mud weight within the MWW. As the drilling progresses past a first depth and into a second, or deeper section, flow drilling can begin, i.e., an amount of gas can be drawn into the wellbore annulus and controlled to achieve pressures in the first section that are less than the fracture pressure of the one or more weak zones surrounding the first section. As a result, the drilling mud can return to surface via the wellbore annulus without fracturing the weak zones in the first, or shallower section. This accordingly prevents uphole weak zones from being fractured while managing deeper high-pressure zones with multiphase flow drilling, thereby reducing or eliminating the need for intermediate casings in the relatively shallower sections.

Interpretation of Terms

Unless the context clearly requires otherwise, throughout the description and the "comprise", "comprising", and the like are to be construed in an inclusive sense, as opposed to an exclusive or exhaustive sense; that is to say, in the sense of "including, but not limited to"; "connected", "coupled", or any variant thereof, means any connection or coupling, either direct or indirect, between two or more elements; the coupling or connection between the elements can be physical, logical, or a combination thereof; "herein", "above", "below", and words of similar import, when used to describe this specification, shall refer to this specification as a whole, and not to any particular portions of this specification; "or", in reference to a list of two or more items, covers all of the following interpretations of the word: any of the items in the list, all of the items in the list, and any combination of the items in the list; the singular forms "a", "an", and "the" also include the meaning of any appropriate plural forms.

Where a component is referred to above, unless otherwise indicated, reference to that component should be interpreted as including as equivalents of that component any component which performs the function of the described component (i.e., that is functionally equivalent), including components which are not structurally equivalent to the disclosed structure which performs the function in the illustrated exemplary embodiments.

Various modifications to those embodiments will be readily apparent to those skilled in the art, and the generic principles defined herein may be applied to other embodiments without departing from the spirit or scope of the disclosure. Thus, the present disclosure is not intended to be limited to the embodiments shown herein, but is to be accorded the full scope consistent with the claims. All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. It is therefore intended that the following appended claims and claims hereafter introduced are interpreted to include all such modifications, permutations, additions, omissions, and sub-combinations as may reasonably be inferred. The scope of the claims should not be limited by the preferred embodiments set forth in the examples but should be given the broadest interpretation consistent with the description as a whole.

What is claimed is:

1. A method for drilling a wellbore, the method comprising:

a) drilling a first section of the wellbore, the first section having a first fracture pressure and a first pore pressure;

b) applying a backpressure on the wellbore;

c) drilling a second section of the wellbore, the second section being downhole from the first section and having a second pore pressure, wherein drilling the second section comprises using drilling mud having a mud weight less than the second pore pressure to draw gas from a formation around the second section into the wellbore;

d) monitoring, while drilling the second section, an annulus pressure in the first section, wherein monitoring the annulus pressure comprises: receiving at surface a two-phase drilling mud mixture from the wellbore, the two-phase drilling mud mixture containing the gas and a liquid; separating the gas from the liquid in the two-phase drilling mud mixture to provide a separated gas and a separated liquid; measuring a flow rate of the separated gas; determining the annulus pressure in the first section based, at least in part, on the flow rate of the separated gas;

e) comparing the annulus pressure with the first fracture pressure and the first pore pressure; and f) one of: if the annulus pressure is between the first fracture pressure and the first pore pressure, maintaining the backpressure on the wellbore;

if the annulus pressure is at or above the first fracture pressure, decreasing the backpressure on the wellbore; and if the annulus pressure is at or below the first pore pressure, increasing the backpressure on the wellbore.

2. The method of claim 1 wherein the first section is a vertical section of the wellbore and the second section is a horizontal section of the wellbore.

3. The method of claim 1 comprising repeating steps d) to f).

4. The method of claim 1 wherein determining the annulus pressure in the first section comprises:

measuring a flow rate, a density, and a viscosity of the separated liquid;

determining a viscosity and a density of the gas;

dividing the length of the first section into a plurality of grids, each grid of the plurality of grids having a grid temperature and a grid pressure; and determining the grid pressure of each grid based, at least in part, on the backpressure, the flow rate, the density, and the viscosity of the separated liquid, the flow rate of the separated gas, and the density and the viscosity of the gas.

5. The method of claim 4 comprising determining the grid temperature of each grid.

6. The method of claim 5 wherein the grid pressure of a grid of the plurality of grids is determined iteratively by:

$$P_j^i = P_{j-1}^i + P_{H_{j-1\to j}}^{i-1} + P_{F_{j-1\to j}}^{i-1}$$

where PI is the grid pressure of the grid at the ith iteration, $P_{j-1}^{\ i}$ is the grid pressure of a previous grid immediately uphole from the grid, $P_{H_{j-1\to j}}^{\ i-1}$ is a hydrostatic pressure taking into account the increase in depth from the previous grid to the grid, and $$P_{F_{j-1\to j}}^{i-1}$$

is an annular pressure loss.

7. The method of claim 6 wherein the plurality of grids has an uppermost grid representing an area of the first section closest to surface and the method comprises iteratively determining the grid pressure for each grid of the plurality of grids, sequentially starting from the uppermost grid, until a maximum difference between two consecutively calculated grid pressures for the same grid is smaller than a predetermined tolerance E:

$$|P_j^{i+1} - P_j^i| \leq \epsilon.$$

8. The method of claim 4 wherein, for each grid of the plurality of grids, the density $\rho_g$ of the gas is determined by:

$$\rho_g = \frac{PMW}{ZRT}$$

where P is the grid pressure of each grid, MW is gas molecular weight of the gas, Z is a gas compressibility factor, R is the universal gas constant, and T is the grid temperature of each grid.

9. The method of claim 8 wherein the gas compressibility factor Z is determined by Peng-Robinson equation of state or Soave-Redlick-Kwong equation of state.

* * * * *